United States Patent [19]

Steele

[11] Patent Number: 4,790,727

[45] Date of Patent: Dec. 13, 1988

[54] SWASHPLATE COMPRESSOR FOR AIR CONDITIONING SYSTEMS

[75] Inventor: Duane F. Steele, Dearborn, Mich.

[73] Assignee: Ford Motor Company, Dearborn, Mich.

[21] Appl. No.: 101,110

[22] Filed: Sep. 25, 1987

[51] Int. Cl.[4] ..... F04B 27/08

[52] U.S. Cl. ..... 417/269; 92/71; 92/147

[58] Field of Search ..... 417/269; 92/71, 147

[56] References Cited

U.S. PATENT DOCUMENTS

| | | | |
|---|---|---|---|
| 3,864,801 | 2/1975 | Nakayama et al. | 29/156.4 |
| 3,888,604 | 6/1975 | Oshima et al. | 417/269 |
| 3,955,899 | 5/1976 | Nakayama et al. | 417/269 |
| 4,070,136 | 1/1978 | Nakayama et al. | 417/269 |
| 4,226,572 | 10/1980 | Nakayama et al. | 417/269 |
| 4,394,110 | 7/1983 | Ishizuka | 417/269 |
| 4,413,955 | 11/1983 | Kato et al. | 417/270 |
| 4,683,803 | 8/1987 | Miller et al. | 417/269 X |

FOREIGN PATENT DOCUMENTS

| | | | |
|---|---|---|---|
| 110783 | 7/1982 | Japan | 417/269 |

*Primary Examiner*—Paul F. Neils

*Attorney, Agent, or Firm*—Donald J. Harrington; Keith L. Zerschling

[57] ABSTRACT

A swashplate air conditioning compressor comprising a two-part compressor housing with a generally cylindrical region and integral end plates, a pair of cylinder blocks disposed in said cylindrical region and defining axially disposed cylinder openings, a centrally disposed swashplate and shaft assembly within the cylinder blocks, and cast refrigerant intake and discharge passages in each end plate that cooperate with valve plate assemblies between the cylinder heads and the end plates.

9 Claims, 9 Drawing Sheets

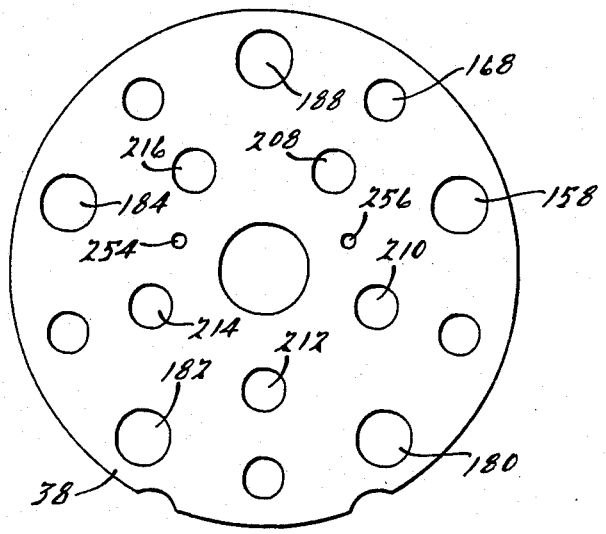
FIG. 9.
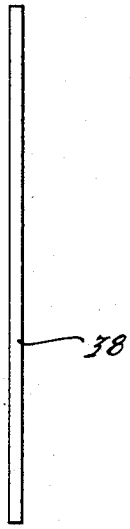
FIG. 10.
FIG. 11.
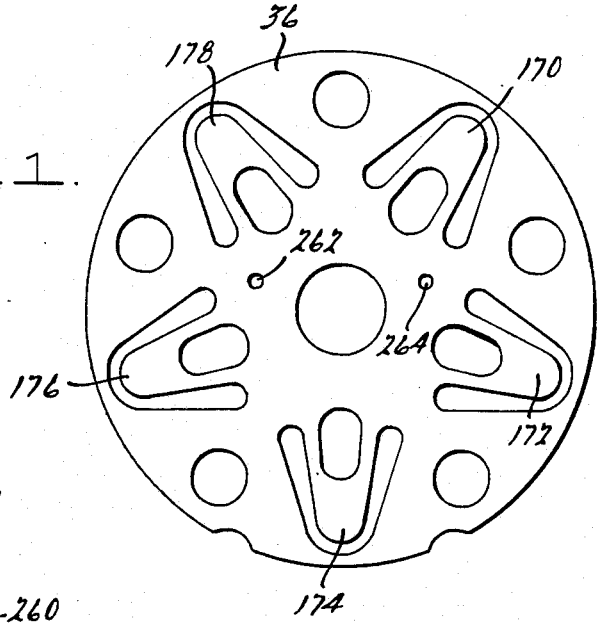
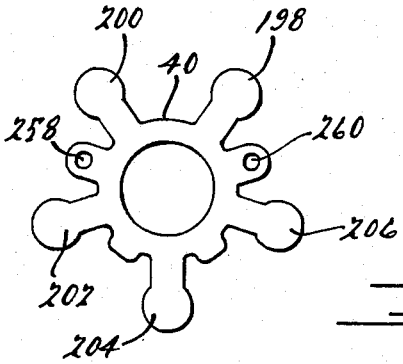
FIG. 12.

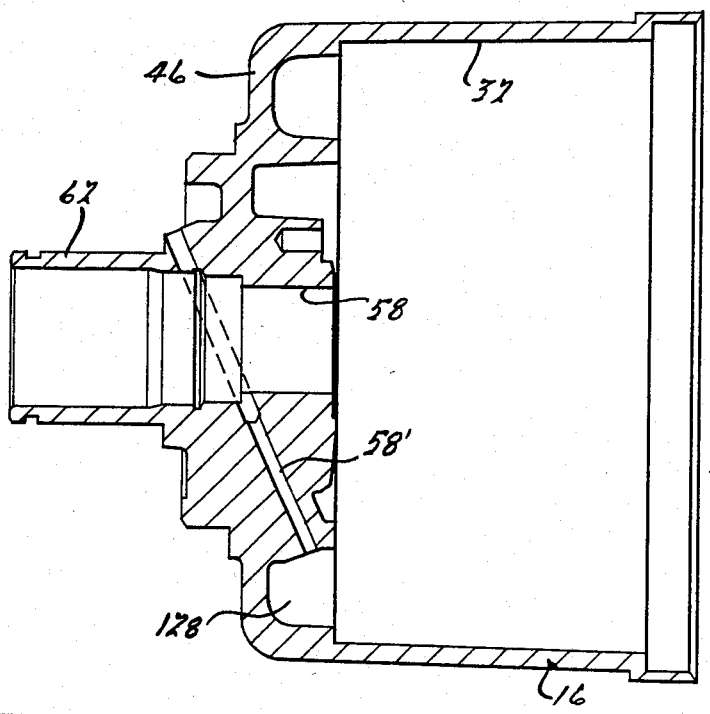
FIG. 15.
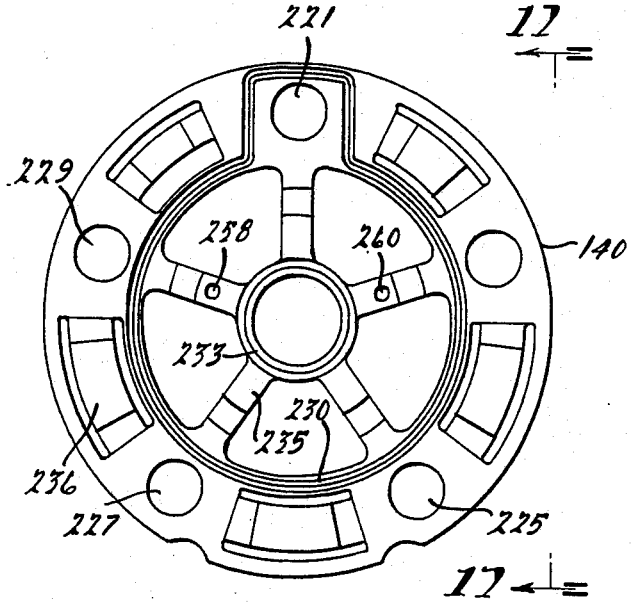
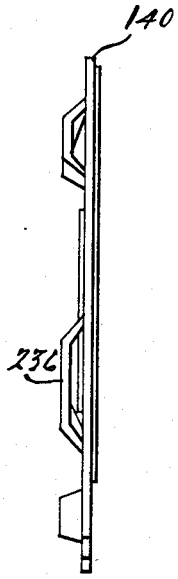
FIG. 16.
FIG. 17.

SWASHPLATE COMPRESSOR FOR AIR CONDITIONING SYSTEMS

BACKGROUND OF THE INVENTION

My invention relates generally to multiple piston swashplate compressors. It is an improvement in known multiple piston swashplate compressors used in the automobile industry, examples of which may be seen by referring to U.S. Pat. Nos. 3,955,899; 3,864,801; 4,413,955; and 4,070,136.

Prior art swashplate compressors for automobile air conditioning systems may comprise cast aluminum alloy housings as illustrated, for example, in the prior art patents mentioned above. The cast housing usually is formed with two main housing parts, each of which has multiple piston openings formed therein. The piston openings of one cast housing part are adapted to register with and to be aligned with companion openings in the other cast housing part. A unitary piston assembly is mounted in the cylinder openings formed by the housing parts. Each piston assembly is provided with a bearing assembly that registers with an angled swashplate piston actuator that is secured to a driveshaft extending parallel to the axes of the cylinders. The cylinders are arranged in uniformly spaced angular relationship about the axis of the shaft. Thus when the shaft is rotated, the swashplate and the swashplate bearing assembly cause the pistons to reciprocate axially within their cylinders.

A valve plate assembly normally is located at each axial end of the cylinders. Intake and exhaust valves are disposed adjacent the valve plates, and front and rear cylinder heads are secured to each of the cylinder castings adjacent each valve assembly.

This prior art construction requires four separate castings including the two cylinder heads, which must be secured together by clamping bolts and sealed, one with respect to the other, to prevent leakage of refrigerant.

Prior art compressor constructions of this type present complex manufacturing operations when they are manufactured in high volume. The necessity for multiple castings increases the manufacturing costs, assembly time and machining. Furthermore, the castings of the prior art design are provided with internal porting with intake fittings and pressure delivery fittings located at the center of the casting so that the inlet fittings and pressure delivery fittings extend radially with respect to the axis of the shaft. This complicates the packaging of such compressors in a vehicle engine compartment where economy of space is of utmost importance.

BRIEF DESCRIPTION OF THE INVENTION

It an object of the invention to reduce the cost normally associated with multiple casting swashplate compressor designs and to reduce machining and assembly time as well as complexity in the manufacture of such compressors for automotive vehicles. With the foregoing in mind, I have developed a compressor housing comprising a two piece outer casting with a single center seal which eliminates many of the potential leak points in prior art compressor designs. Located in the two piece outer housing are two interchangeable cylinder blocks that are fitted together in end-to-end relationship during assembly within the outer cast housing.

Unlike prior art designs such as those described above, my present design does not require the use of separate cylinder heads, or end plates. The porting normally associated with the end plates or the cylinder heads is formed in the base of each of the housing parts during the casting operation.

A valve plate, as well as inlet and outlet reed valves, are located between the ends of the cast cylinder blocks and the adjacent inner ends of the cast housing parts. Each inner end of the cast housing parts is formed with valve porting and with refrigerant pressure and supply passages that communicate with the cylinders through the valve reeds. The high pressure ports in the inner ends of the cast housing parts communicate, one with respect to the other by means of through passages cast in the cylinder blocks. Thus the outer cast housing is not required to accommodate a cross-over refrigerant flow passage nor an inlet passage for the refrigerant.

The low pressure through passage in the cylinder blocks communicates with the regions of the cylinder blocks that are occupied by the swashplate shaft assembly so that the flow circuit is capable of cooling and lubricating the swashplate and bearing assembly as well as the bearings for the rotating shaft portion of the swashplate and shaft assembly.

The reentrant flow path of the refrigerant as it passes from the inlet fitting and through the low pressure passages in the cylinder blocks assumes relatively even distribution of refrigerant to each of the cylinders. This avoids distribution of a "slug" of refrigerant to any one cylinder, thus avoiding stresses that could cause malfunctioning or compressor breakdown.

Tee refrigerant discharge reed valve, the inlet reed valve and the associated valve plates are located by retainer pins secured within the inner end of the cast housing parts, the opposite ends of the pins registering with a locating opening in the adjacent wall of the cylinder block. A head gasket having an embossed area that engages the discharge reed valve is located between the end of the associated cast housing part. The head gasket thus holds the discharge reed against the valve plate and seals the discharge gases from the low pressure side of the compressor. It is not necessary to use a seal coating on the head gasket since the embossment on the gasket provides an adequate seal separating the high pressure regions of the compressor from the low pressure regions.

The clamping bolts that secure the two housing parts in end-to-end relationship provide the necessary clamping pressure for the two cylinder blocks and for the valve plate and reed valve assemblies at each axial end of the cylinder blocks. The same clamping pressure, of course, also effects a seal at the juncture of the two cast housing parts, a compression seal ring being provided at that juncture.

By eliminating a multiple seal arrangement of prior art designs and by locating the cylinder blocks separately within the outer two part cast housing, where the cylinder block surfaces are not contiguous with an exterior compressor housing surface, the possibility of leakage of refrigerant is reduced or eliminated. Furthermore the reduction in dimensions that is made possible by my improved, compact design reduces the overall weight of the assembly This size reduction also makes it feasible for use in vehicle engine compartments of limited space.

BRIEF DESCRIPTION OF THE FIGURES OF THE DRAWINGS

FIG. 9 is a plan view of the front of the valve plate used in the assembly.

FIG. 10 is an edge or end view of the plate of FIG. 9 as seen from the plane of section 10—10 of FIG. 9.

FIG. 11 is a plan view of an inlet valve reed positioned at each axial end of the cylinder blocks.

FIG. 12 is a plan view of the outlet or discharge valve reed located at each axial end of the cylinder blocks.

FIG. 15 is a sectional view taken along the plane of section line 14A—14A of FIG. 14.

FIG. 16 is a plan view of the gasket for the discharge reed valve and valve plate at each end of the cylinder blocks.

FIG. 17 is an edge or end view of the gasket as seen from the plane of section line 16—16 of FIG. 15.

PARTICULAR DESCRIPTION OF THE INVENTION

Figure 1:
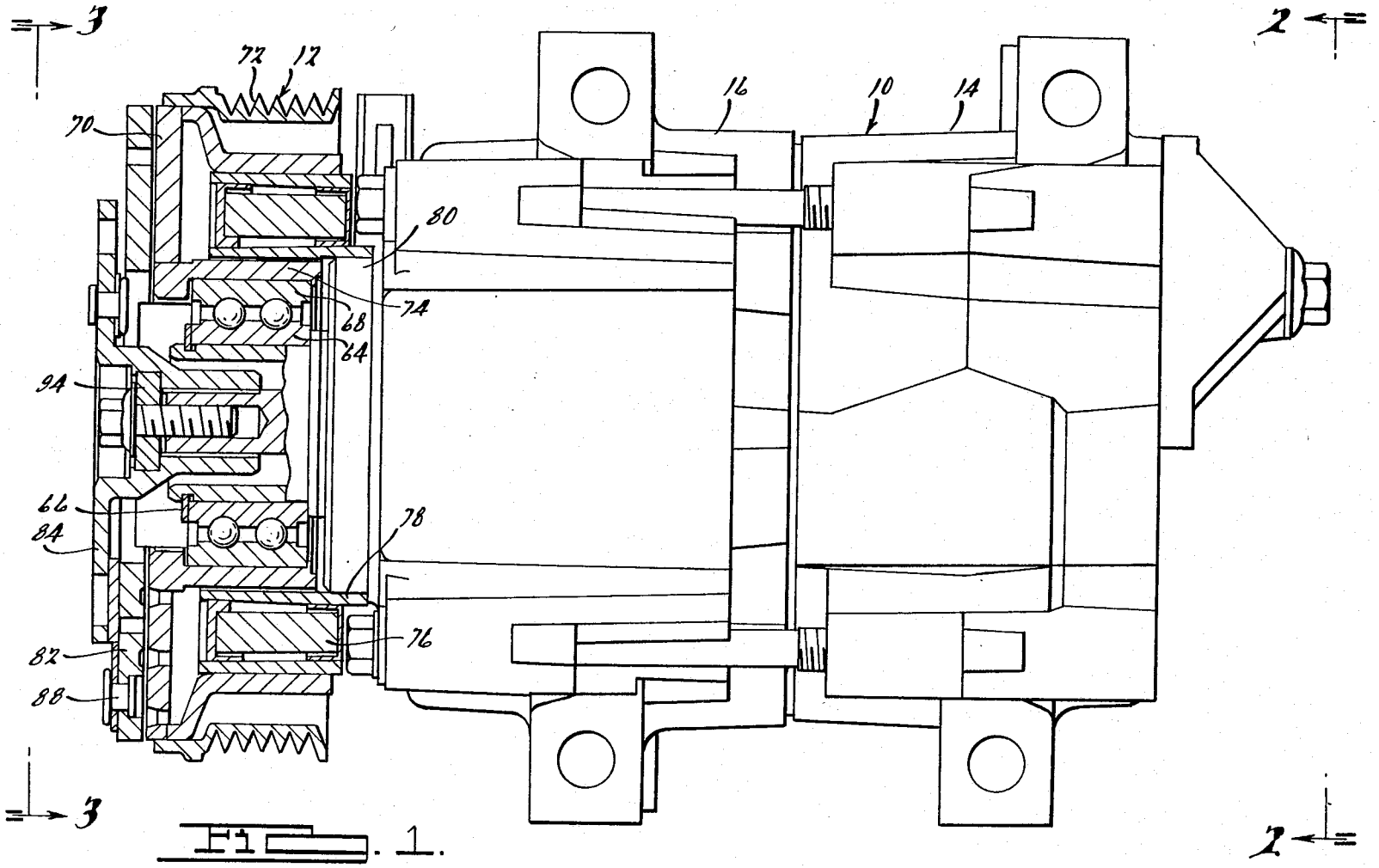
FIG. 1 is a cross-sectional assembly view of a compressor and clutch assembly embodying the features of my design.
Figure 1A:
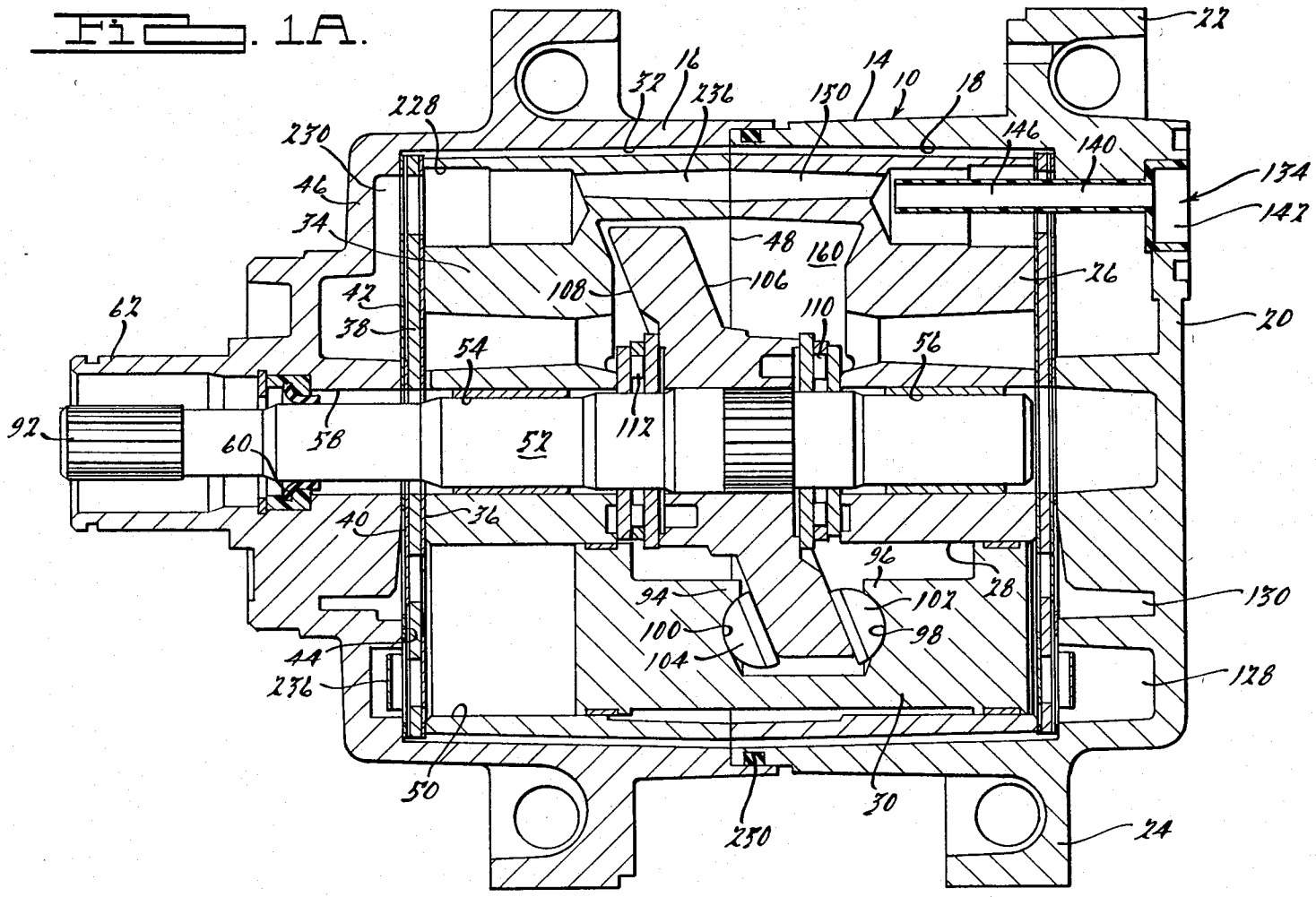
FIG. 1A is a cross-section view similar to the view of FIG. 1 taken through a plane that is offset with respect to the plane of FIG. 1 and which eliminates a showing of the clutch assembly.
Figure 2:
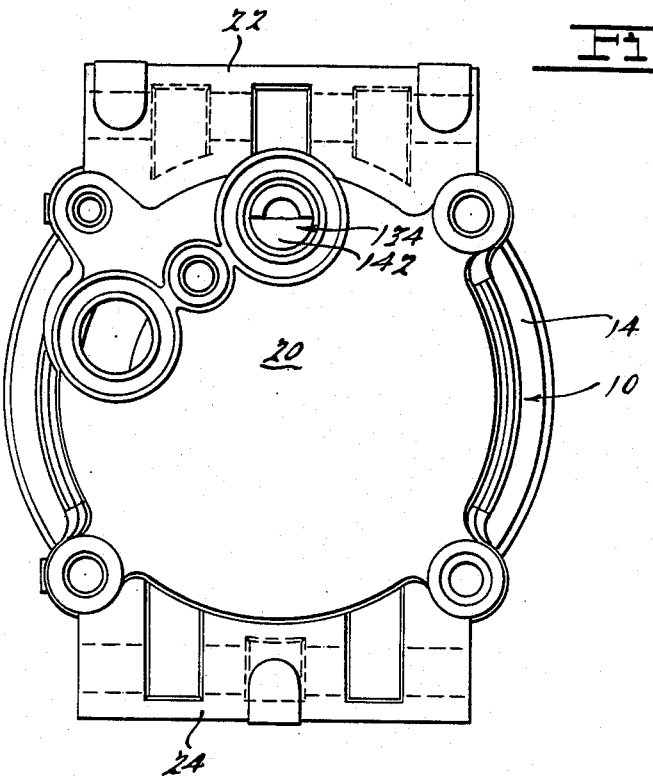
FIG. 2 is an end view of the structure of FIG. 1 as seen from the plane of section line 2—2 of FIG. 1.

In FIGS. 1 and 1A reference character 10 designates generally a cast housing for the air conditioning compressor. Numeral 12 in FIG. 1 designates the electromagnetic clutch assembly used with the compressor.

Housing 10 includes a rear housing part 14 and a front housing part 16, each of which is formed of die cast aluminum alloy. Housing part 14 has a cylindrical interior 18 and an integral end wall 20 that forms a part of the die casting. Mounting bosses 22 and 24 are formed as part of the die casting, and mounting bolts are received in bolt openings formed in the bosses 22 and 24.

A die cast aluminum cylinder body 26, in which is formed a plurality of cylinder openings, is itself of cylindrical shape and is fitted within the opening 18 with a very small clearance between the inner diameter of the cylindrical opening 26 of the housing 14 and the outer diameter of the cylinder body 26.

One of the cylinder openings in the cylinder body 26 is shown at 28. A compressor piston 30 is slidably received in the cylinder opening 28.

The front compressor head comprises the companion housing part 16. Like the housing part 14, housing part 16 has a circular central opening as seen at 32. A cylinder body 34, which itself is of cylindrical shape, is received in the cylindrical opening 32 with a minimum clearance between its outer diameter and the inside diameter of the cylindrical opening 32.

An inlet valve plate in the form of a circular spring steel disc is identified by reference numeral 36. That disc will be described with reference to FIG. 11. Adjacent the disc 36 is a front valve plate 38, which has formed in it valve openings that are registered with reed valve elements of the inlet valve disc 36. This front valve plate 38 will be described with reference to FIG. 9.

A front discharge valve plate 40, which will be described with reference to FIG. 12, is located directly adjacent valve plate 38. It is formed with reed valve elements that register with valve openings formed in valve plate 38.

A front gasket plate 42 is disposed between the front discharge valve plate 40 and the end surface 44 of the opening 32 formed in the housing part 16. Surface 44 is a machined surface on the inner face of the end wall 46 of the housing part 16.

As seen in FIG. 1A, the cylinder block 30 is assembled in abuting relationship with respect to the cylinder block 34, the abuting surfaces being identified by common reference numeral 48. As seen in FIG. 1A, cylinder opening 28 is aligned with cylinder opening 50 in cylinder block 34 thus forming a common cylinder for the reciprocating piston 30.

A swashplate shaft 52 is journalled by bushing 54 in cylinder block 34 and by bushing 56 in cylinder block 26. Shaft 52 extends through end plate opening 58 in the end plate 46. A fluid seal 60 seals the interior of the housing as the shaft 52 rotates in shaft opening 58.

A stationary sleeve shaft extension 62 is formed on the end plate 46 and provides a support for electromagnetic clutch 12. The inner race 64 of a rotary ball bearing support is supported by the shaft extension 62 and is held in place by snap ring 66. This can be seen by referring to FIG. 1.

The outer bearing race 68 for the clutch 12 rotatably supports a pulley plate 70. A pulley drum 72 secures the outer margin of the plate 70 and the inner margin of the plate 70 is provided with a hub 74 that is supported by the outer race 68.

An electromagnetic coil assembly 76 is located radially inward of the pulley drum. It includes a coil assembly casing 78, which is secured in fixed fashion to shoulder 80 of the housing part 16.

Figure 3:
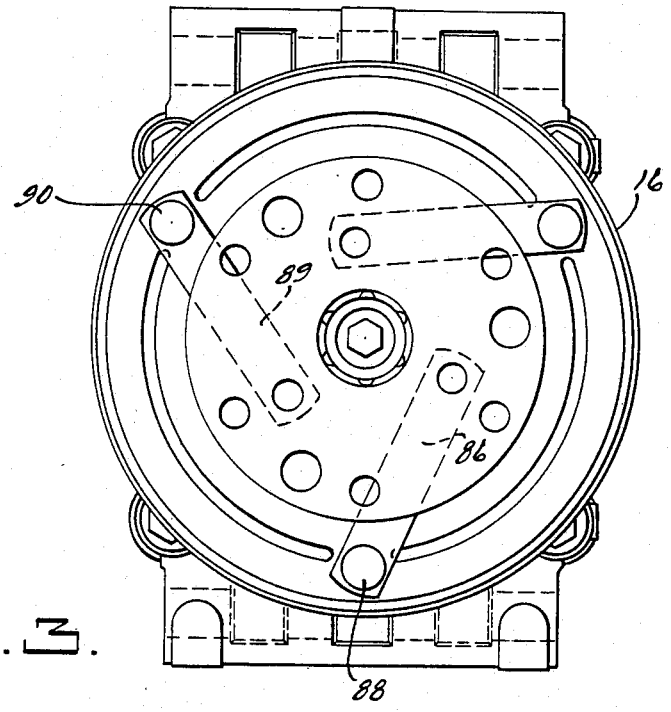
FIG. 3 is an end view of the structure of FIG. 1 as seen from the place of section line 3—3 of FIG. 1.

An armature plate 82 is positioned adjacent the pulley plate 70. It is connected to an armature hub 84 by means of leaf springs as seen in FIG. 3. These are indicated by reference characters 86 and 89. One end of each of the springs is riveted to the armature hub 84 and the other end is secured by rivets 88 and 90 to the pulley plate 70. When the coil 76 is energized, the armature plate 82 frictionally engages the pulley plate 70 thereby providing a driving connection between the pulley 72 and the shaft 52 through the armature hub 84, the latter being splined to spline portion 92 on the shaft 52 as seen in FIG. 1A. Clamping bolt 94, as seen in FIG. 1, retain the armature plate and hub assembly securely to the shaft 52.

Figure 8:
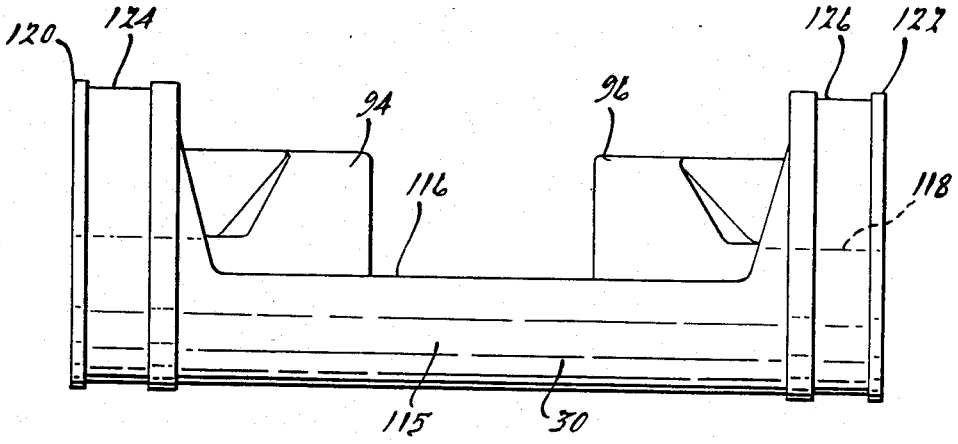
FIG. 8 is a side view of a piston adapted to be received in a cylinder of the cylinder block of FIGS. 4 and 5.

As seen in FIG. 1A and in FIG. 8, the piston comprises two juxtaposed bosses 94 and 96, which are machined to provide semi-spherical pocket recesses 98 and 100 for swashplate slippers 102 and 104, respectively. The slippers are provided with a flat bearing surface that slidably engage surfaces 106 and 108, respectively, on the swashplate and shaft assembly shown in FIG. 1A and in FIG. 6.

Figure 6:
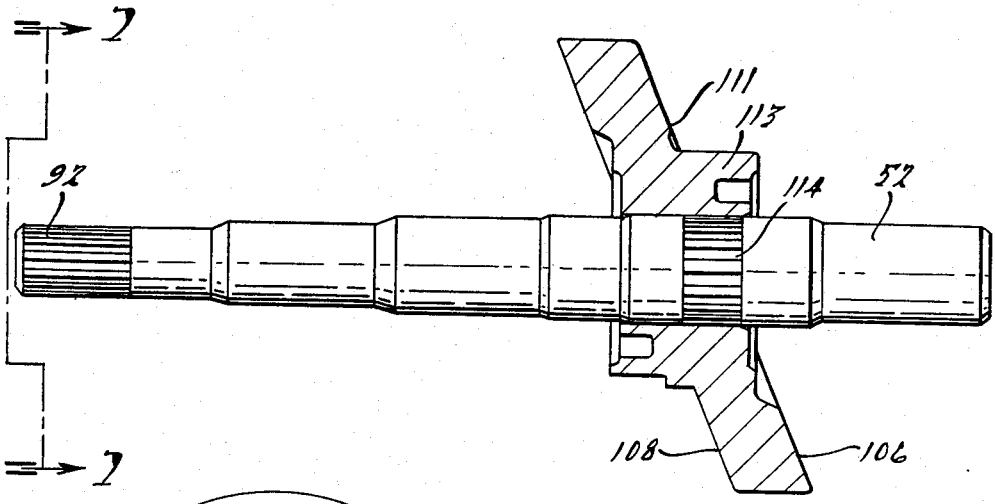
FIG. 6 is a side elevation view of a swashplate and shaft assembly which forms a part of the assembly of FIG. 1.
Figure 7:
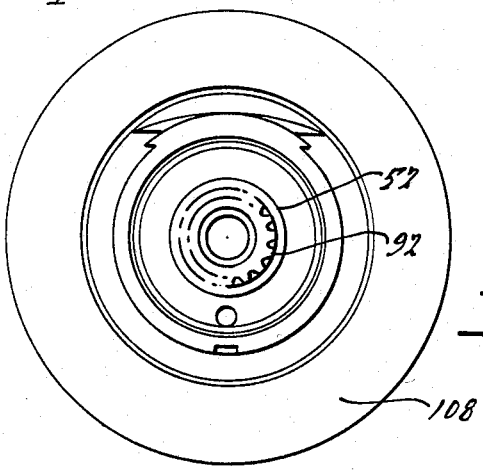
FIG. 7 is an end view of the structure of FIG. 6 as seen from the plane of section line 7—7 of FIG. 6.

The swashplate is disposed as seen best in FIG. 6, at an angle relative to the axis of the shaft. The swashplate itself, which is designated by reference character 111, includes a hub 113 that is press fitted on the shaft 52 and that is locked in place by serrations 114 formed on the shaft 52 prior to the assembly of the swashplate 111 on the shaft by the press fitting operation. As the shaft 52 rotates, the swashplate 106, due to the sliding engagement with the slippers 102 and 104, causes the piston 30 to reciprocate in the cylinder defined by cylindrical openings 28 and 50 in the cylinder blocks 26 and 34, respectively. Thrust forces on the swashplate are accommodated by the radial needle bearing assemblies 110 and 112, which respectively engage the cylinder blocks 26 and 34 whereby the thrust on the swashplate hub is absorbed by the cylinder blocks.

The slippers 102 and 104 are formed of sintered metal, and the flat bearing surfaces are porous enough to carry a lubricating oil film thus establishing a nonabrasive sliding bearing relationship with respect to the surfaces 106 and 108 as the pistons are reciprocated.

As best seen in FIG. 8, the piston 30 is formed of a unitary die casting. It includes a bridge portion 115 of reduced depth with respect to the diameter of the ends of the piston. The bridge portion is formed during the die casting operation with an upper surface 116 that is situated below the centerline 118 of the piston. This permits sufficient clearance for the outer margin of the swashplate 111 thereby preventing interference during operation of the compressor. This die casting operation eliminates complex machining operations that are common to reciprocating pistons of swashplate compressors of the kind illustrated in the prior art disclosures mentioned in this specification.

As seen in FIG. 8, the piston is a double acting piston and it is provided with piston ends 120 and 122 of equal diameter. Each end 120 and 122 has a piston seal groove 124 and 126 which receives a piston seal ring.

Figure 13:
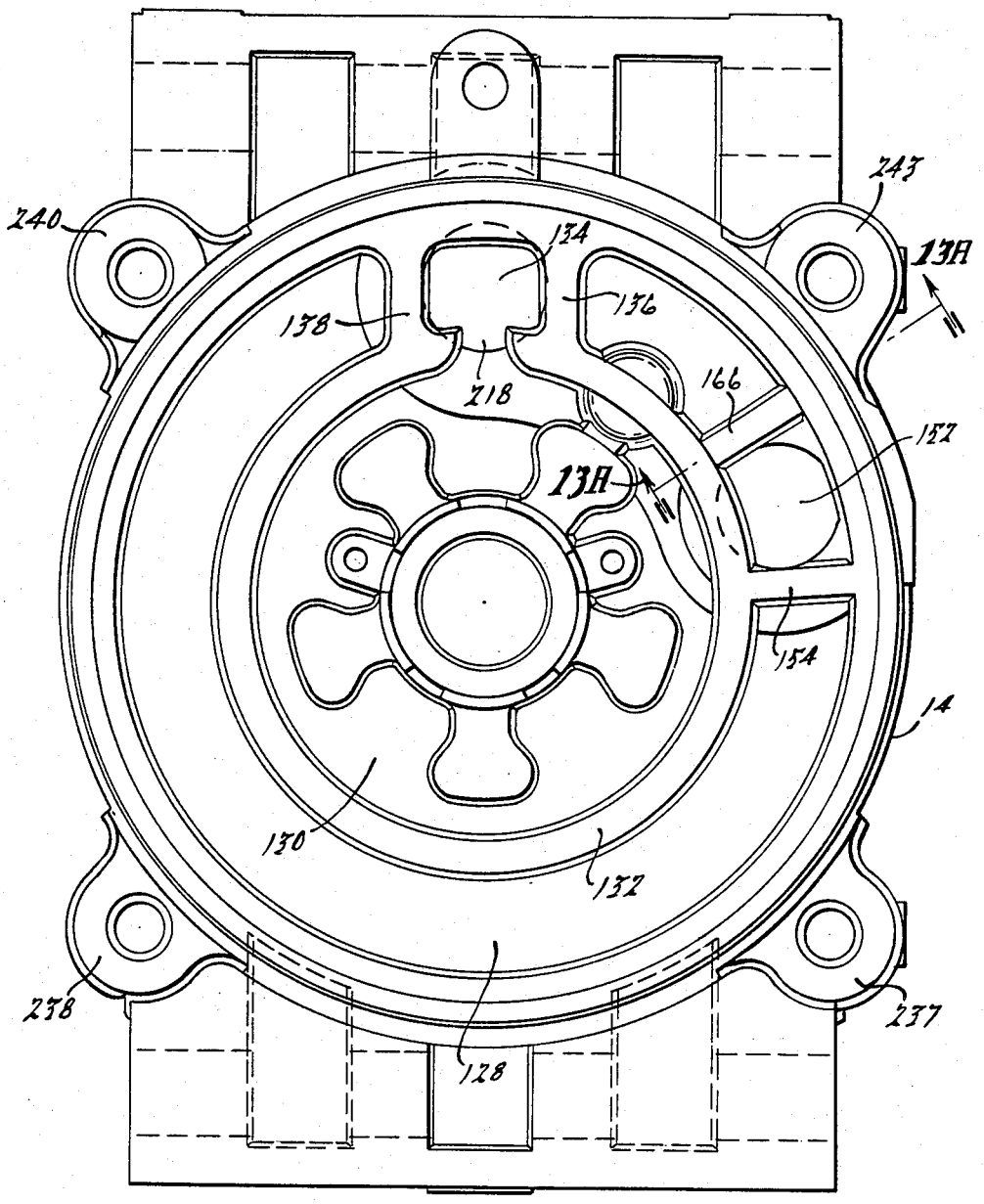
FIG. 13 is an end view of the rear casting head or housing for the assembly. It shows the interior porting and passage arrangement at the end wall of the opening in the casting head.
Figure 13A:
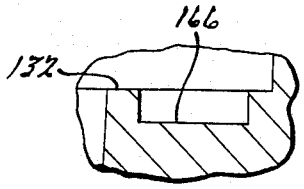
FIG. 13A is a sectional view taken along the plane of section line 13A—13A of FIG. 13.

The rear housing part wall 20 of the housing part 14 has inlet and outlet pressure cavities that are formed in it during the die casting operation. The low pressure inlet cavity encircles the shaft 52 as best seen in FIG. 13 at numeral 128. It is separated from the high pressure passage 130 by a cylindrical baffle 132. The outlet port, which is a high pressure discharge port, is shown in FIGS. 1A and 13 by reference numeral 134. The upper extremity of the cylindrical baffle wall 132, as seen in FIG. 13, registers with and forms a continuation of separater walls 136 and 138 which isolate the outlet passage from the inlet passage 128. Located in the outlet opening 134 is a pulsation damper tube or muffler, preferably made of plastic material. This is indicated in FIG. 1A by reference numeral 140. It includes a cylindrical end piece 142 received in the discharge opening 134. It includes also a reduced diameter extension 146 that is received in the high pressure cavity 130. The left hand end of the extension 146, as seen in FIG. 1A, is received in discharge passage 150 of the rear cylinder block 26. This is seen best by referring to FIG. 4.

When high pressure discharge gases are distributed to the discharge port 150 of the cylinder block 26, those gases pass into the discharge passage 130 formed in the die cast end plate of the housing part 14. But before they can be transferred to the discharge opening 134 they must reverse in their directional flow toward the left hand opening of the extension 146 of the damper 140. The flow passage in the extension 146 is of less area than the flow area of the opening 134. This circuitous flow path for the discharge gases results in a dampening of undesirable pressure pulsations in the delivery of the refrigerant.

In FIG. 13 the inlet opening for the refrigerant is shown at 152. It should be noted in FIG. 13 that communication between opening 152 and the arcuate region of the inlet passage 128 is interrupted by a bridge 154. The plane of the inner surface of the bridge 154 is common to the plane of the inner surface of the baffle wall 132. Gases that enter the port 152, therefore, pass directly through openings 156 in reed valve plate 36 as see in FIG. 11.

Figure 4:
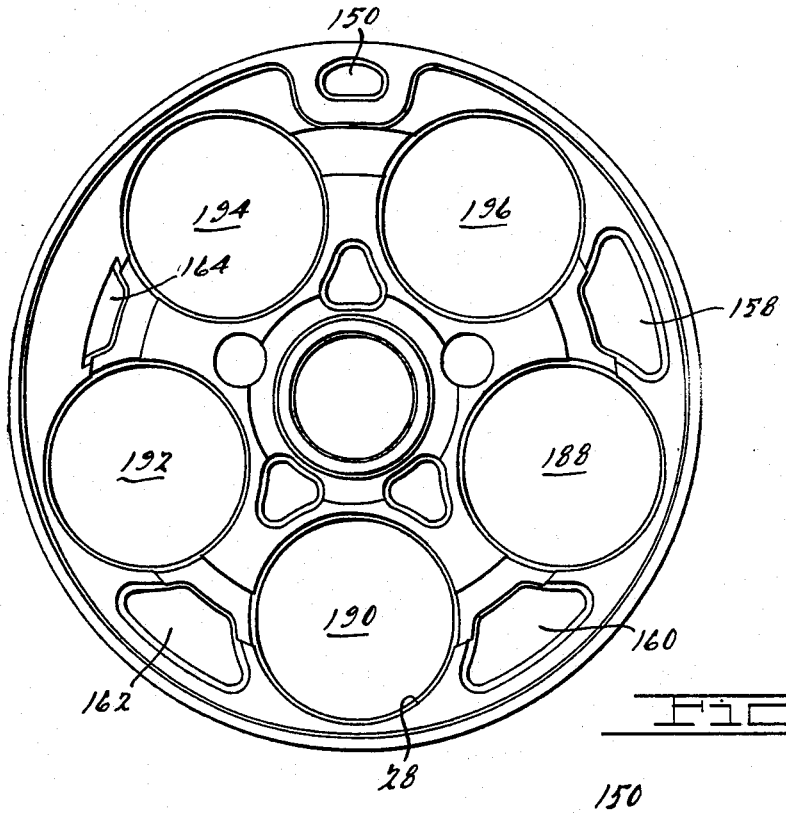
FIG. 4 is an end view of one of the two cylinder blocks that form a part of the assembly of FIG. 1.

The low pressure refrigerant then passes through opening 158 of the rear valve plate 38 shown in FIG. 9. The refrigerant gas then is passed through openings 158 that are cast in the cylinder body 26 as seen in FIG. 4.

The gases then accumulate in the region 160. From there the refrigerant gases pass into each of the other cast low pressure passages 162 and 164 as seen in FIG. 4. The right hand end of each of these cast passages seen in FIG. 4 communicates with the low pressure passage 128 that is cast in the end wall 20 of the housing part 14, as previously described.

As seen in FIG. 13 there is a second bridge 166 which bridges the baffle wall 132 with the outer housing wall. The inner surface of this bridge 166 is lower relative to the base of the inlet passage 128 than the machined surface of the bridge 154. Thus direct communication is permitted between opening 152 and opening 168 formed in the valve plate of FIG. 9.

The valve reed disc of FIG. 11 includes a flexible cantilever valve part 170 which registers with the opening 168 and permits one-way flow through the opening 168 when the piston for the associated cylinder adjacent to it undertakes its intake stroke. The bridge 168 acts as a partial baffle that prevents transfer of a so-called slug of refrigerant in liquid form into the adjacent cylinder and permits relative equal distribution of refrigerant to each of the other cylinders. It does this by assuring that most of the refrigerant, perhaps 80 percent of the inlet flow, is transferred to the cavity 160 and distributed from there through the internal flow intake passages 162 and 164 and 158 from which it is transferred to the cast intake passage 128 formed in the end plate 20 of the housing portion 14.

As seen in FIG. 11, there are multiple cantilever valve elements at 176 and 178 as well as at 170. These valve elements or reeds register with valve plate openings 180, 182, 184, and 186 as well as with opening 158. The cylinder block 26, as seen from FIG. 4, has 5 cylinder openings which accommodate 5 compressor pistons and each cylinder is served by a separate one of the valve reeds shown in FIG. 11. As each piston 130 is stroked in a left hand direction as seen in FIG. 1, refrigerant is drawn through the valve plate opening and past its associated valve reed. Refrigerant is then drawn from the opening 128 in the case of cylinders 188, 190, 192 and 194 which are identified in FIG. 4. In the case of cylinder 196 shown in FIG. 4, refrigerant is drawn directly from the opening 152 across the bridge 168.

The discharge reed assembly of FIG. 12 includes a plurality of reed valve elements separately identified by reference characters 198, 200, 202, 204, and 206. Each of these valve elements registers with high pressure discharge openings 208, 210, 212, 214, and 216, as seen in FIG. 9. Each of these openings serves as a discharge port for the high pressure refrigerant as the pistons for the respective cylinders are stroked in a right hand direction, as seen in FIG. 1A. The discharge reeds shown in FIG. 12 permit one-way flow of high pressure gases into the discharge flow path 130 previously described with reference to FIG. 13. A baffle wall 132 is separated at 218 to permit communication between passage 130 and the discharge passage 134.

Figure 14:
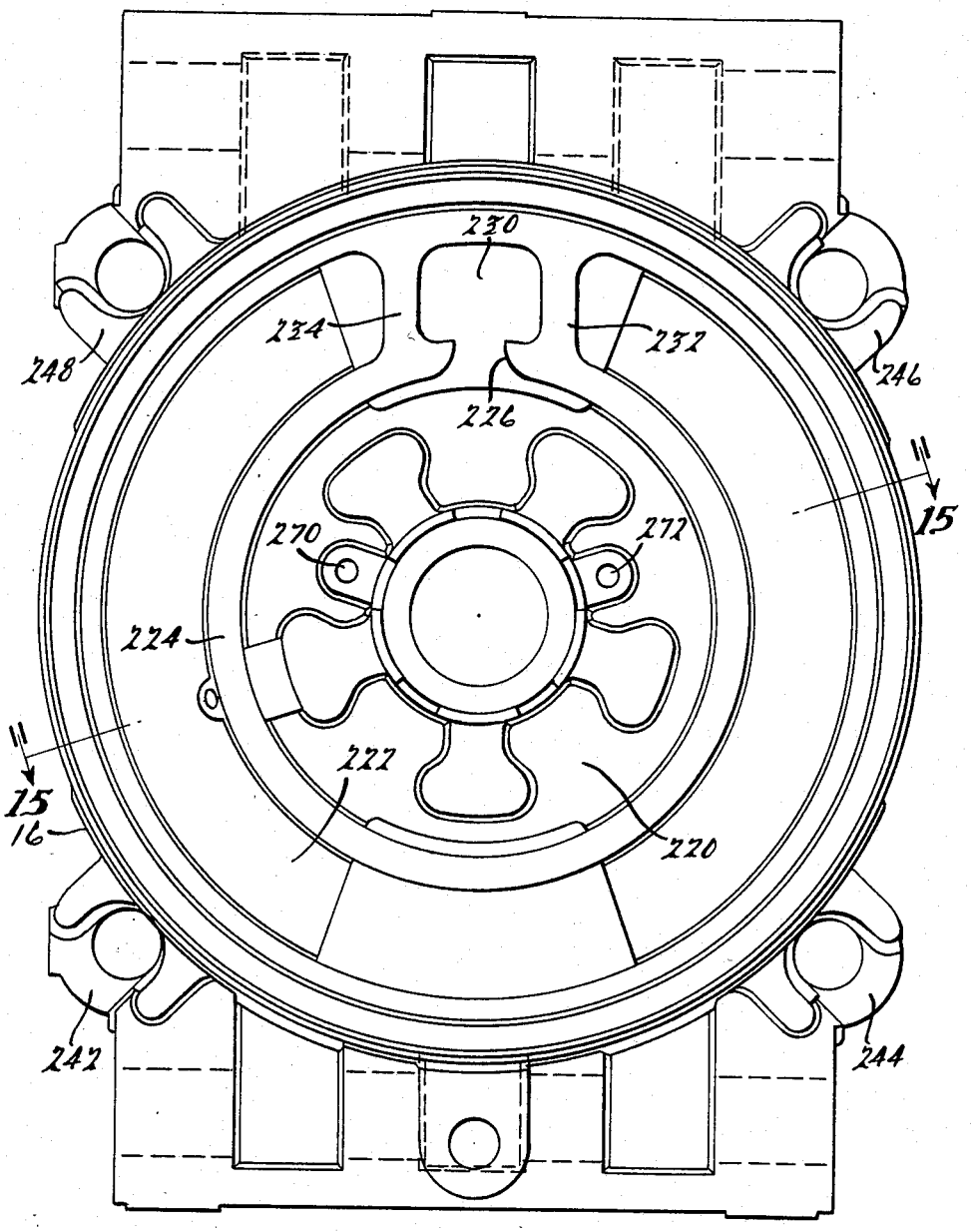
FIG. 14 is an end view of the front casting head of the housing showing the interior of the end wall of the front head together with the porting and passage structure.

The cylinder block 34 is identical and interchangeable with cylinder block 26. The valve plate, the inlet reeds and the discharge reeds described with reference to the rear housing part 14 are identical to those that function with respect to the front housing part 16. Like the rear housing part 14, the front housing part 16 shown in FIG. 14 is provided with cast high pressure and low pressure passages. The high pressure passage shown at 220 corresponds to high pressure passage 130 of the rear housing part. Low pressure passage 222 of FIG. 14 corresponds to low pressure passage 128 of he rear housing part.

A baffle wall 224, which corresponds to the baffle wall 132 of the rear housing part 14, separates passages 220 and 222. The wall 224 is discontinuous as shown at 226 to provide communication between passage 220 and the outlet opening 228 as seen in FIG. 1A. The region 230, seen in FIG. 1A and in FIG. 14, which is the high pressure region, is separated from the low pressure inlet passage 222 by bridge portions 232 and 234 of the baffle wall 224.

Fluid that is discharged by the pumping pistons passes from discharge passage 220 and into the region 230, whereupon it passes through internal crossover passage 236 seen only in FIG. 1A. This passage corresponds to passage 150 that was described with reference to the rear cylinder block of FIG. 4. Passage 150 and passage 236 register at their juncture to form a continuous passage that communicates with the discharge opening 142 seen in FIG. 1A. This internal crossover passage eliminates the need for providing a separate crossover tube as in some prior art arrangements, and it may be formed during the die casting operation with minimal finish machining operations being required.

I have shown in FIG. 16 a gasket or seal plate that is interposed between the valve plate and the inner machined surface of the front and rear housing parts. The gasket of FIG. 16, which was described with reference to FIG. 1A and identified by reference numeral 140, includes an opening 221 with a high pressure opening 186 in the valve plate 38 of FIG. 9. It includes also openings 223, 225, 226, and 229 which register with cast end openings in the front cylinder block, which in turn correspond to the cast end openings previously described with reference to the cylinder block 26 shown in FIG. 4. These respectively are shown at 150, 158, 160, 162 and 164.

FIG. 16 shows at 230 an embossment which encircles the axis of the shaft 52 and which envelopes the opening 221. The embossment registers with the reed valve plate 36 and the machined inner surface of the baffle wall 224, as shown in FIG. 14. It registers also with the red valve plate 36 and the machined surface of the bridge portions 232 and 234 of the baffle wall 224. Thus the embossment forms an effective seal that isolates the high pressure cast passage 220 from the low pressure cast passage 222. The gasket or seal of FIG. 16 includes also an inner embossment ring 233 which prevents passage of high pressure refrigerant from the high pressure discharge port for the cylinders from the region of the bearing 54 and the shaft opening 58.

A similar gasket or seal plate is used to seal the high pressure and low pressure passages in the end plate 20 of the rear housing part 14.

The valve plate for the front cylinder block is identical to the valve plate for the rear cylinder block. Similarly, the inlet valve reeds and the discharge valve reeds for the front and rear cylinder blocks are identical, one with respect to the other. This interchangeability, as well as the interchangeability of the cylinder blocks themselves, simplifies both the design and the manufacture and assembly of the components, thus making it possible to achieve reduced manufacturing costs and improved reliability during operation following assembly Radial arms, one of which is shown at 235 in FIG. 16, support the hub of the gasket on which the inner embossment 233 is formed.

Near the radially outer margin of the gasket of FIG. 16 are straps 236 which provide rigidity to the disc but which are displaced out of the plane of the gasket thereby permitting free flow of refrigerant gas through the valve plate openings and past the inlet valve reeds. The relative position of the straps 236 with respect to the plane of the gasket can be seen by referring to FIG. 1 where the gasket is shown in cross section.

As seen in FIG. 13 the rear housing part 14 has four external bosses 237, 238, 240, and 242. Similarly, the front housing part 16 has bosses 243, 244, 246 and 248, which register with the bosses 237, 238, 240, and 242 of the front housing part 16. Each of these bosses has a bolt opening to permit entry of a clamping bolt. When the bolts are tightened following assembly of the components, the cylinder blocks are brought into registry, one with respect to the other, and a predetermined load is applied to the gasket. Effective seals thus are established The left hand margin of the housing part 14 is received within the right hand margin of the housing part 16, as seen in FIG. 1A, and an "O" ring seal 250, which is received in an "O" ring groove in the housing part 14, establishes a fluid tight seal between the mating parts.

Figure 5:
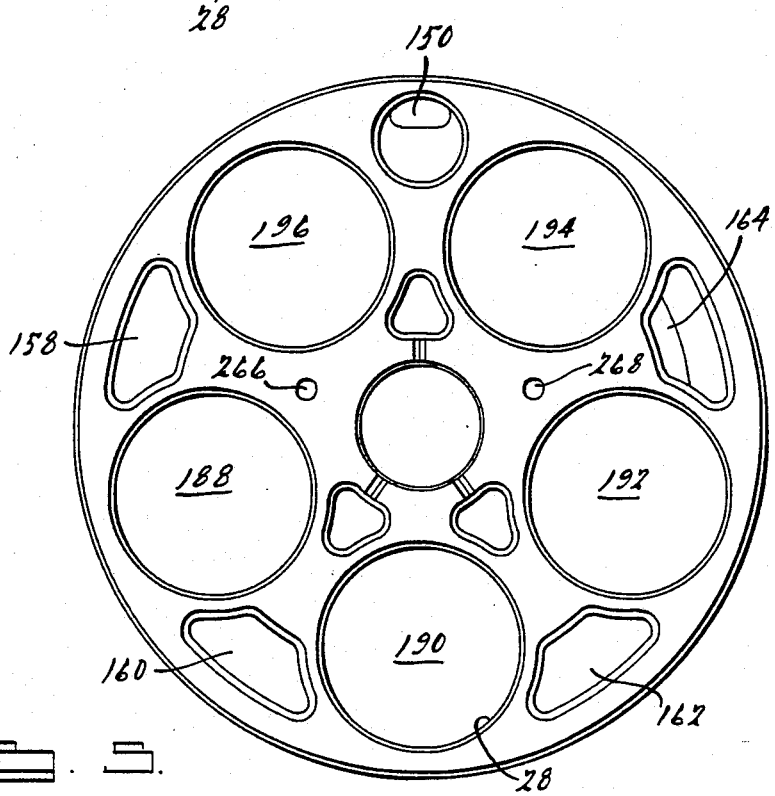
FIG. 5 is an end view showing the opposite end of the cylinder block of FIG. 4.

The previously mentioned slipper shoes that engage the surfaces 106 and 108 of the swashplate are formed of powdered metal that may be heat treated to a hardness of over 40 Rockwell C. It is possible, therefore, to eliminate the necessity for using a separate shoe on the movable slipper element as in prior art designs such as those shown in the prior art references mentioned in the preceding portion of this specification. Only the slide bearing surfaces need be finished by grinding or by lapping. The shoes themselves may or may not be tumbled after they are finished. In addition to the interchangeability of the parts—for example, the inlet valve disc, the discharge valve disc and the valve plate—preassembly of the valve plate with the gasket and the two reed valve discs can be achieved by locater pins which are received in pin openings formed in valve plate 38 illustrated in FIG. 9. These pins are received with a force fit in pin openings 254 and 256 as seen in FIG. 9. Corresponding openings 258 and 260 are formed in the discharge valve of FIG. 12, and these register with the locater pins. Similarly, locater pin openings 258 and 260 are formed in the gasket as formed in FIG. 16, and these also register with the locater pins. On the opposite side of the valve plate, pin openings 262 and 264, as seen in FIG. 11, register with the valve pins. Thus the valve plate, the inlet valve disc, the discharge valve disc, and the gasket can be preassembled to simplify the manufacturing operation. After this preassembly procedure the subassembly is inserted into registering pin locater openings 266 and 268, shown in FIG. 5 for the rear housing part. Corresponding pin openings 270 and 272 for the front housing part can be seen in FIG. 14. These locater pins establish proper angular registry of the assembled parts, one with respect to the other. No fasteners are required and the manufacturing cost and assembly cost and improved reliability by a simplified assembly is achieved.

Manufacturing operations are simplified further by the piston construction as explained previously. The piston construction has a bridge area that does not require finished machining. The bridge area is formed during the die casting operation and it permits the swashplate outside diameter at maximum displacement to extend beyond the bosses for the slippers. There is no need for machining a relief area in the bridge surface as in the prior art constructions, examples of which are shown in the references described in this specification. It is permissible with this design for the swashplate to engage the bridge surface with a running engagement on the midpoint surfaces of the bridge.

The improved design further provides improved reliability and simplified manufacturing operations by reason of the die casting process for forming the swashplate itself. It is normal practice in the design of a swashplate compressor to use a cast forge process or by using a forging process without casting. The depth between the face of the shoe and the hub of the swashplate is sufficiently reduced in our design to assure sufficient strength. The presence of the refrigerant in the region of the swashplate provides sufficient lubrication because sufficient lubricating oil is present. Then the refrigerant gas permits an oil film to be developed continuously over which the slippers may act.

The bearings 54 and 56 for the shaft 52 are steel backed sleeve bearings which can be assembled with no further machining being required after installation. These are located, as seen in FIG. 1A, adjacent radial needle bearings 112 and 110 respectively. The cage for the radial rollers of the bearings 112 and 110 rotate in the usual fashion between two thrust washer rings. This establishes a centrifugal pumping action which draws lubricant and refrigerant from the inboard ends of the sleeve bearings. A pressure differential exists between the swashplate chamber and the inlet annulus that is cast in each of the end plates for the housing parts. The existence of this pressure differential creates a pressure differential across the bearings themselves and this is aided by the centrifugal action of the rotating cages of the radial needle bearings, which act as thrust bearings. Thus the cages of the radial needle bearings, which act as thrust bearings, and the journal bearings are lubricated thereby further improving the reliability of the compressor. Additional lubrication is provided by the leakage of fluid across the bearing 54 into the seal chamber defined by shaft opening 58. A buildup of pressure in the seal chamber is avoided by reason of bypass passage 58' connecting opening 58 and low pressure intake passage 128 as seen in FIG. 15.

Having described a preferred embodiment of my invention, what we claim and desire to secure by U.S. Letters Patents is:

1. An air conditioning compressor comprising:

two generally cylindrical housing portions, one end of each housing portion being open and having an end wall closing the other end;

the open ends of said housing portions being assembled in end-to-end relationship thus defining an internal cylindrical cavity;

a pair of cylinder blocks in said cavity disposed in juxtaposed relationship, each cylinder block having a plurality of axially disposed cylinder openings arranged in angularly spaced relationship about the axis of said cavity, each cylinder opening in one cylinder block being aligned with an opening in the other cylinder block, a plurality of double acting pistons each having one end thereof received in the corresponding cylinder opening of said one cylinder block and the opposite end received in the aligned cylinder opening of said other cylinder block whereby said double acting pistons align said cylinder blocks with respect to each other;

the end wall of each housing portion being formed with refrigerant pressure discharge and supply cavities forming refrigerant flow passages;

each said piston being axially movable with reciprocating motion in its cylinder, sliding slipper bearings on each said piston;

a swashplate and driveshaft assembly journalled in said cylinder blocks including a swashplate disposed in a plane forming an angle relating to the axis of said cylinder blocks, the swashplate being slidably engaged by said slipper bearings whereby said pistons are reciprocated when said swashplate and driveshaft assembly is rotated;

a valve assembly disposed adjacent each of said end walls whereby refrigerant is distributed therethrough from said supply cavity and to said cylindrical openings and from said cylindrical openings to said pressure discharge cavity from said cylindrical openings; and each cylinder block being formed with axial refrigerant supply passages that communicate with the supply cavities in said end walls, and a refrigerant supply passage including an inlet port in one of said housing portions and a through passage in each cylinder block that distributes refrigerant from said inlet port to the region of said swashplate whereby said refrigerant supply passages are supplied with refrigerant with a relative uniform distribution of refrigerant.

2. The combination as set forth in claim 1 wherein each of said valve assemblies includes a valve plate, an inlet valve disc adjacent said valve plate and engaging one side of an adjacent cylinder block, and a discharge valve disc between said valve plate and an adjacent face of an end wall of a housing portion.

3. The combination as set forth in claim 2 wherein said housing portions include a seal ring at tee juncture of open ends of said housing portions, said housing portions having external bosses through which bolt openings are formed, clamping bolts in said bolt openings whereby said housing portions may be clamped together as well as the cylinder blocks and valve assemblies to establish a sealed assembly, spaced sleeve bearings supporting said swashplate and driveshaft assembly in said cylinder block, a shaft opening in each housing portion receiving said swashplate and driveshaft assembly and a low pressure passage connecting the supply cavity of one end wall and one of said shaft openings.

4. The combination as set forth in claim 3 wherein said valve assembly includes at least one locator pin, said valve plate and each of said valve discs having openings that receive said pin thereby providing a means to form a preassembled sub-assembly for said valve assembly, and openings in adjacent surfaces of an end wall of a housing portion and in a cylinder block whereby said valve assembly is angularly oriented relative to said piston openings.

5. The combination as set forth in claim 1 wherein said housing portions include a seal ring at the juncture of open ends of said housing portions, said housing portions having external bosses through which bolt openings are formed, clamping bolts in said bolt openings whereby said housing portions may be clamped together as well as the cylinder blocks and valve assemblies to establish a sealed assembly, spaced sleeve bearings supporting said swashplate and driveshaft assembly in said cylinder block, a shaft opening in each housing portion receiving said swashplate and driveshaft assembly and a low pressure passage connecting the supply cavity of one end wall and one of said shaft openings

6. The combination as set forth in claim 5 wherein each of said valve assemblies includes a seal plate disc that is disposed between one of said end walls and said discharge valve disc, and a linear embossment formed on said seal plate disc that engages said inlet valve disc and an adjacent surface of said one end wall whereby the discharge cavity in said one wall is sealed from and isolated with respect to the supply cavity in said one wall.

7. The combination as set forth in claim 6 wherein said valve assembly includes at least one locator pin, said valve plate and each of said valve discs having openings that receive said pin thereby providing a means to form a preassembled sub-assembly for said valve assembly, and openings in adjacent surfaces of an end wall of a housing portion and in a cylinder block whereby said valve assembly is angularly oriented relative to said piston openings.

8. The combination as set forth in claim 1 wherein each of said valve assemblies includes a seal plate disc that is disposed between one of said end walls and said discharge valve disc, and a linear embossment formed on said seal plate disc that engages said inlet valve disc and an adjacent surface of said one end wall whereby the discharge cavity in said one wall is sealed from and isolated with respect to the supply cavity in said one wall.

9. The combination as set forth in claim 8 wherein said valve assembly includes at least one locator pin, said valve plate and each of said valve discs having openings that receive said pin thereby providing a means to form a preassembled sub-assembled for said valve assembly, and openings in adjacent surfaces of an end wall of a housing portion and in a cylinder block whereby said valve assembly is angularly oriented relative to said piston openings.

* * * * *